US005918851A

United States Patent [19]

Whitby

[11] Patent Number: 5,918,851

[45] Date of Patent: Jul. 6, 1999

[54] BLOWOUT PREVENTER RAM AUTOMATIC LOCKING SYSTEM

[75] Inventor: Melvyn F. Whitby, Houston, Tex.

[73] Assignee: Cooper Cameron Corporation, Houston, Tex.

[21] Appl. No.: 09/033,962

[22] Filed: Mar. 3, 1998

[51] Int. Cl.[6] ..... E21B 33/06

[52] U.S. Cl. ..... 251/1.3; 251/1.1

[58] Field of Search ..... 251/1.1, 1.3

[56] References Cited

U.S. PATENT DOCUMENTS

| | | | |
|---|---|---|---|
| 3,242,826 | 3/1966 | Smith | 92/24 |
| 3,941,141 | 3/1976 | Robert | 137/1 |
| 4,076,208 | 2/1978 | Olson | 251/1 A |
| 4,290,577 | 9/1981 | Olson | 251/1 A |
| 4,293,115 | 10/1981 | Parks, Jr. et al. | 251/1 A |
| 4,305,565 | 12/1981 | Abbe | 251/1 A |
| 4,519,571 | 5/1985 | Jones et al. | 251/1 A |
| 4,523,639 | 6/1985 | Howard, Jr. | 166/55 |
| 4,601,232 | 7/1986 | Troxell, Jr. | 92/24 |
| 4,840,346 | 6/1989 | Adnyana et al. | 251/1.3 |
| 4,969,627 | 11/1990 | Williams, III | 251/1.3 |
| 5,025,708 | 6/1991 | Smith et al. | 92/19 |
| 5,056,418 | 10/1991 | Granger et al. | 251/1.1 |
| 5,575,452 | 11/1996 | Whitby et al. | 251/1.3 |

OTHER PUBLICATIONS

"Shaffer® UltraLock® Automatic Ram Locking System", Apr. 1993, 2 Pages.

"Shaffer® UltraLock™ II Automatic Ram Locking System", No Date, 2 Pages.

"Hydril® Ram Locking Systems", Apr. 1994, pp. 34–35.

*Primary Examiner*—John Fox

*Attorney, Agent, or Firm*—Jackie Lee Duke

[57] ABSTRACT

A blowout preventer ram automatic locking apparatus for use in a ram-type blowout preventer used in oil and gas drilling operations is disclosed. The blowout preventer has a body with an axial bore, a pair of opposing bonnet assemblies and a pair of opposing rams laterally moveable within the bonnet assemblies by a pressurized fluid source to control flow of well fluids through the blowout preventer body axial bore. The blowout preventer ram automatic locking apparatus includes a bonnet header sealingly connected to the side of the blowout preventer body with an operating cylinder sealingly connected to the bonnet header. An operating piston is connected to the ram and moves axially within the operating cylinder in response to pressurized fluid supplied through porting in the bonnet header and end cap. A plurality of locking pistons are circumferentially spaced about the operating piston in locking piston chambers and are axially moveable in response to fluid pressure. The locking pistons include an axially tapered cylindrically shaped surface on one end. A bonnet cap is sealingly connected to the operating cylinder and bonnet header and includes a plurality of circumferentially spaced axially tapered cylindrically shaped surfaces. An end cap sealingly engages the bonnet cap. The locking piston chambers each include a radially disposed window that receives a locking segment in radially sliding engagement. The locking segments have acutely angled interior and exterior axially tapered cylindrically shaped faces to cooperate with the locking pistons and bonnet cap acutely angled axially tapered cylindrically shaped surfaces. The locking segments are moved radially in response to fluid pressure applied to the locking pistons. Movement of the locking segments radially outward to a locked position maintains the operating piston and ram in a closed position.

18 Claims, 6 Drawing Sheets

BLOWOUT PREVENTER RAM AUTOMATIC LOCKING SYSTEM

BACKGROUND OF THE INVENTION

1. Field of the Invention

This invention relates to an improved blowout preventer ram actuating and locking apparatus for a ram-type blowout preventer used in oil and gas drilling operations. Ram-type blowout preventers are part of a pressure control system used in oil and gas drilling operations to control unexpected well bore pressure spikes or "kicks" as they are commonly referred to in the industry.

The blowout preventer has a body with a vertical bore and a pair of laterally disposed opposing bonnet assemblies. Each bonnet assembly includes a piston that is laterally moveable within the bonnet assembly by pressurized hydraulic fluid. When these pistons are moved to a closed position, commonly referred to as "closing the blowout preventer" or "closing the rams", the vertical bore of the blowout preventer is sealed and the "kick" is contained. Replaceable sealing elements called "rams" are mounted on the ends of the pistons that extend into the blowout preventer bore. These "rams" are available in a variety of configurations designed to seal the blowout preventer bore when the opposing pistons are moved to their closed position. One type of ram has ends designed to seal around pipe of a specific size in the blowout preventer bore when the blowout preventer is "closed." Other rams are configured to shear any pipe in the blowout preventer bore during closing while still others are designed to seal around a range of pipe sizes.

It is imperative that the rams stay closed during a kick until the well bore pressure can be controlled. The well bore pressure can reach several thousand pounds per square inch during a "kick." In the event that hydraulic control pressure is lost or removed, the rams could be forced open by the well bore pressure and cause an uncontrolled pressure well bore release or "blowout." In order to ensure the rams remain closed and the well bore pressure contained during a hydraulic system failure, an automatic blowout preventer ram lock is required. It is such an automatic blowout preventer ram lock to which the present invention is directed. As noted above the blowout preventer rams are available in a variety of configurations. Additionally, the rams themselves experience a considerable amount of wear during their normal use. These factors require that an automatic blowout preventer ram lock be capable of locking the ram and its associated piston in a range of positions depending on the type of ram being used and the amount of wear on the ram.

Numerous locking devices for use with ram-type blowout preventers have been used since the early days of the industry. Problems associated with these prior blowout preventer ram locks include complexity of operation, expensive to manufacture and maintain and adding unnecessary width to the blowout preventer assembly. The automatic blowout preventer ram lock of the current invention offers a substantial improvement by offering a simple, easy to maintain ram lock that is considerably more compact than similar ram locks.

2. Description of Related Art

Various types of ram lock designs are well known to those of ordinary skill in the art. These designs all fail in one or more respects to address the problems described.

U.S. Pat. No. 3,242,826 to W. W. Smith shows an early version of a blowout preventer ram lock. This apparatus can only lock the ram in a single position.

A number of designs have used a ratcheting apparatus that cooperates with the mating teeth formed on the ram piston or an extension thereof. Notable among these are U.S. Pat. Nos. 3,941,141 (Robert); 4,076,208 (Olson); 4,290,577 (Olson); 4,293,115 (Parks, Jr. et al.) and 4,840,346 (Adnyana et al.)

Another group of designs has used a wedge shaped locking member that cooperates with a tapered end on the rear of the ram to lock the ram. These include U.S. Pat. Nos. 4,969,627 (Williams III); 4,523,639 (Howard, Jr.) and 4,601,232 (Troxell, Jr.).

A final group has relied on various wedge shaped members that are axially moveable to lock between a mating surface on the ram and the bonnet housing. These include U.S. Pat. Nos. 4,305,565 (Abbe); 4,519,571 (Jones et al.); 5,025,708 (Smith et al.) and 5,575,452 (Whitby et al.)

SUMMARY OF THE INVENTION

The blowout preventer ram automatic locking apparatus of the present invention is designed for use in a ram-type blowout preventer used in oil and gas drilling operations. The blowout preventer has a body with an axial bore, a pair of opposing bonnet assemblies and a pair of opposing rams laterally moveable within the bonnet assemblies by a pressurized fluid source to control flow of well fluids through the blowout preventer body axial bore. The blowout preventer ram automatic locking apparatus includes a bonnet sealingly connected to the side of the blowout preventer body with an operator cylinder sealingly connected to the bonnet. An operating piston is connected to the ram and moves axially within the operator cylinder in response to pressurized fluid supplied through porting in the bonnet and operator cylinder. These ports include a ram unlock port for moving the operating piston and ram to an open position and a ram lock port for moving the operating piston and ram to a closed position.

A plurality of locking pistons are circumferentially spaced about the operating piston in locking piston chambers. The locking pistons seal within the locking piston chambers and are axially moveable with the operating piston. The locking pistons include an axially tapered cylindrical surface on one end. A lock housing is sealingly connected to the operator cylinder and bonnet and includes a plurality of circumferentially spaced axially tapered cylindrical surfaces. An end cap sealingly engages the lock housing. The locking piston chambers each include a radially disposed window that receives a plurality of locking components in radially sliding engagement. The locking components have axially tapered cylindrical surface faces to cooperate with the locking pistons and the lock housing axially tapered cylindrical surfaces. The locking components are moved radially in response to fluid pressure applied to the locking pistons. Movement of the locking pistons radially outward to a locked position maintains the operating piston and ram in a closed position.

It is a principal object of the present invention to provide a blowout preventer ram automatic locking apparatus that allows automatic locking of the blowout preventer rams over a wide range of motion without requiring manual operator intervention.

Another object of the present invention is to provide a blowout preventer ram automatic locking apparatus that will reliably maintain the blowout preventer rams in their locked and sealed position even if hydraulic pressure is unintentionally lost.

A final object of the present invention is to provide a blowout preventer ram automatic locking apparatus that is rugged and reliable while being economical to manufacture and maintain.

These with other objects and advantages of the present invention are pointed out with specificness in the claims annexed hereto and form a part of this disclosure. A full and complete understanding of the invention may be had by reference to the accompanying drawings and description of the preferred embodiments.

BRIEF DESCRIPTION OF THE DRAWINGS

These and other objects and advantages of the present invention are set forth below and further made clear by reference to the drawings, wherein.

DESCRIPTION OF THE PREFERRED EMBODIMENT

Figure 1:
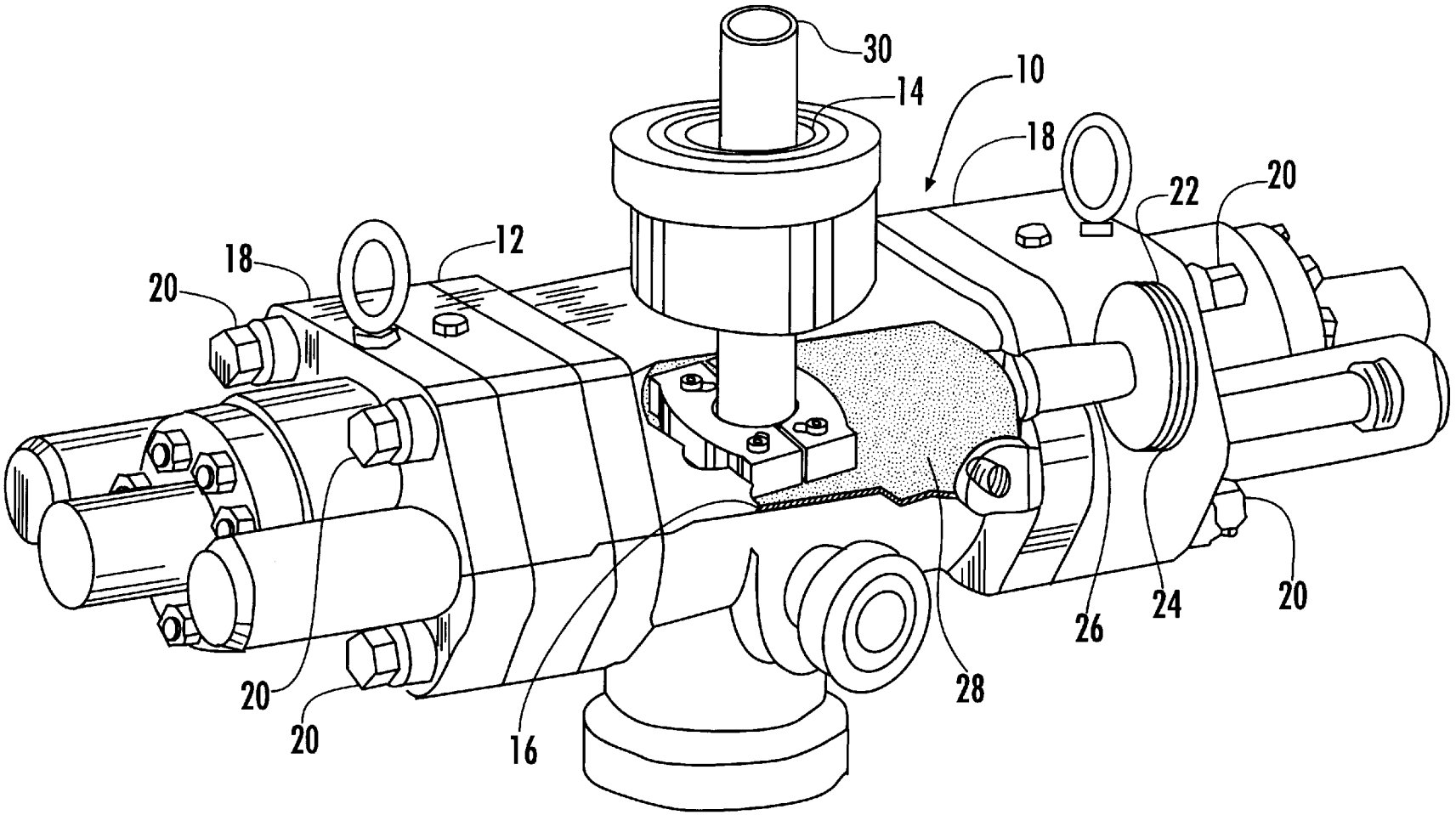
FIG. 1 is a perspective view with a cutaway section of the blowout preventer ram automatic locking apparatus of the present invention installed in a typical ram-type blowout preventer used in oil and gas drilling operations.

With reference to the drawings, and particularly to FIG. 1, a perspective view with a cutaway section of the blowout preventer ram automatic locking apparatus of the present invention installed in a typical ram-type blowout preventer used in oil and gas drilling operations is shown. The ram type blowout preventer 10 is shown in the closed position. Ram type blowout preventer 10 conventionally includes a body or housing 12 with a vertical bore 14 and laterally disposed ram guideways 16. Bonnet assemblies 18 are mounted to the body 12 with studs 20 and aligned with laterally disposed guideways 16. Each bonnet assembly 18 includes an actuation means 22, including a piston 24 and connecting rod 26. Each connecting rod 26 is connected to a ram packer 28. Ram packer 28 is operated by actuation means 22 allows ram packer 28 to be reciprocated within guideways 16 or "opening and closing the rams" as it is referred to in the industry. As shown in FIG. 1, ram packers 28 are in the closed position, thereby sealing around drill pipe 30 and allowing an operator to control a kick. Within bonnet assembly 18 is the blowout preventer ram automatic locking system 32 of the present invention.

Figure 2:
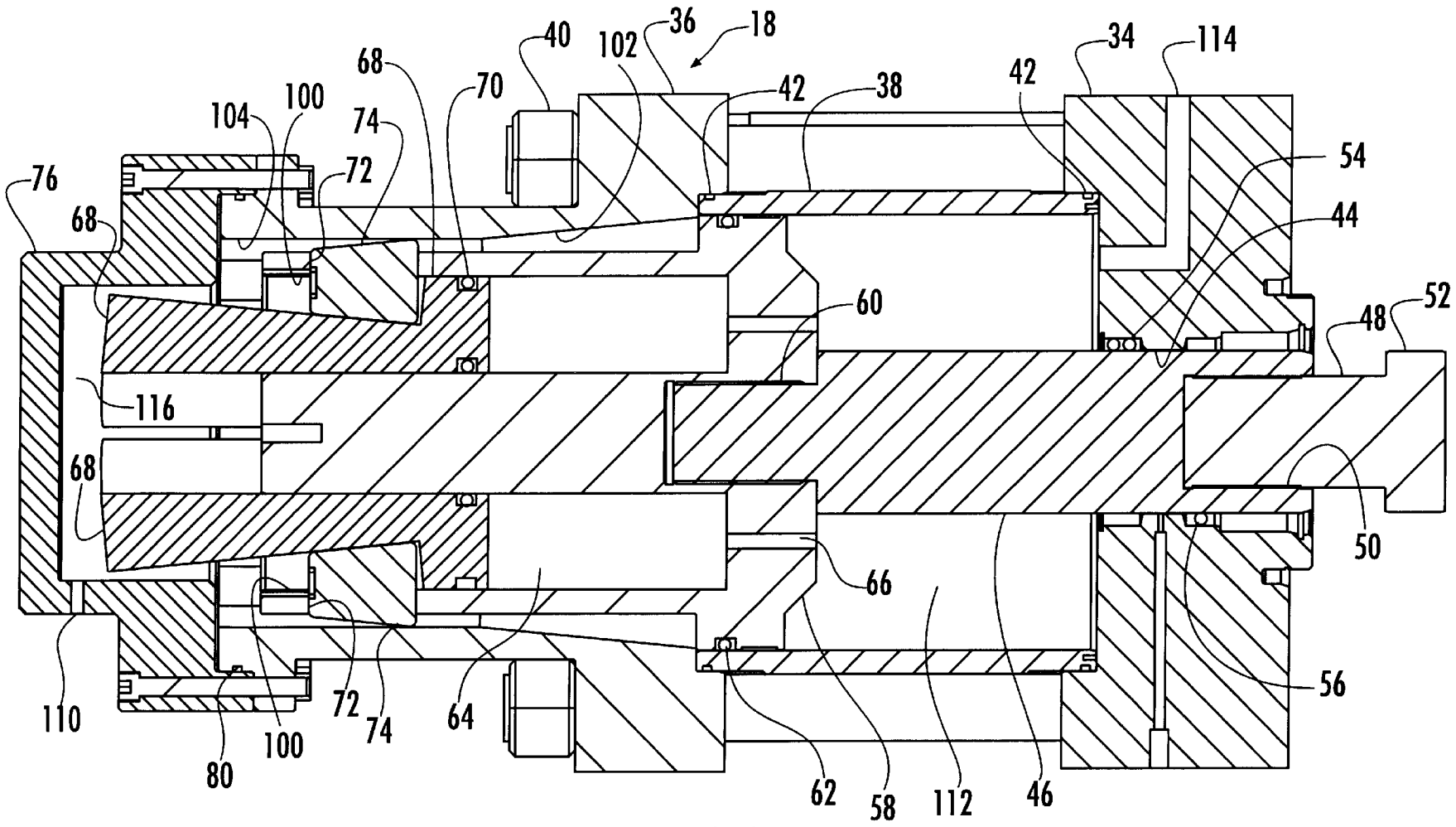
FIG. 2 is a sectional view of the blowout preventer ram automatic locking apparatus unlocked and the rams open.

FIG. 2 is a sectional view of the blowout preventer ram automatic locking system 32 in its unlocked position. Bonnet assembly 18 includes bonnet header 34, bonnet cap 36 and locking cylinder 38. Locking cylinder 38 is captured between bonnet header 34 and bonnet 36 that are secured together by bolts 40. Seals 42 at each end of locking cylinder 38 seal against bonnet header 34 and bonnet 36 to form a fluid tight cylindrical chamber. Bonnet header 34 has a central bore 44 that piston rod 46 reciprocates within during ram opening and closing operations. Connecting rod 48 is secured to piston rod 46 by threads 50 or other suitable securing means. Connecting rod 48 connects to ram packer 28 (not shown) by T shaped head 52. Thus, reciprocation of piston rod 46 and connecting rod 48 causes the ram packers 28 to open and close about drill pipe 14 as best seen in FIG. 1.

Seals 54 and 56 are positioned within central bore 44 of bonnet header 34 to seal against piston rod 46. Centrally positioned within locking cylinder 38 is operating piston 58 that is secured to piston rod 46 by threads 60 or other suitable securing means. Seals 62 are positioned on the exterior of operating piston 58 to seal against the interior of locking cylinder 38. Operating piston 58 is counterbored on the side opposite piston rod 46 to form a plurality of locking piston chambers 64. Locking piston chambers 64 are circumferentially spaced about operating piston 58 and connected to the opposite side of piston rod 46 by fluid passages 66 for purposes to be explained hereinafter.

A locking piston 68 is positioned within each locking piston chamber 64. Locking piston seal 70 is positioned on the end of locking piston 68 and seals within locking piston chamber 64. A circular cross section segment slot 72 is disposed radially at the outer end of each locking piston chamber 64. Locking segment 74 is positioned within segment slot 72 and radially moveable therein. Locking segment 74 is shaped to cooperate with locking piston 68 in a manner to be described hereinafter. An end cap 76 is connected to bonnet cap 36 by bolts 78 or other suitable retaining means. End cap seal 80 is positioned on the outer end of bonnet cap 36 to seal end cap 76 thereto.

Figure 4:
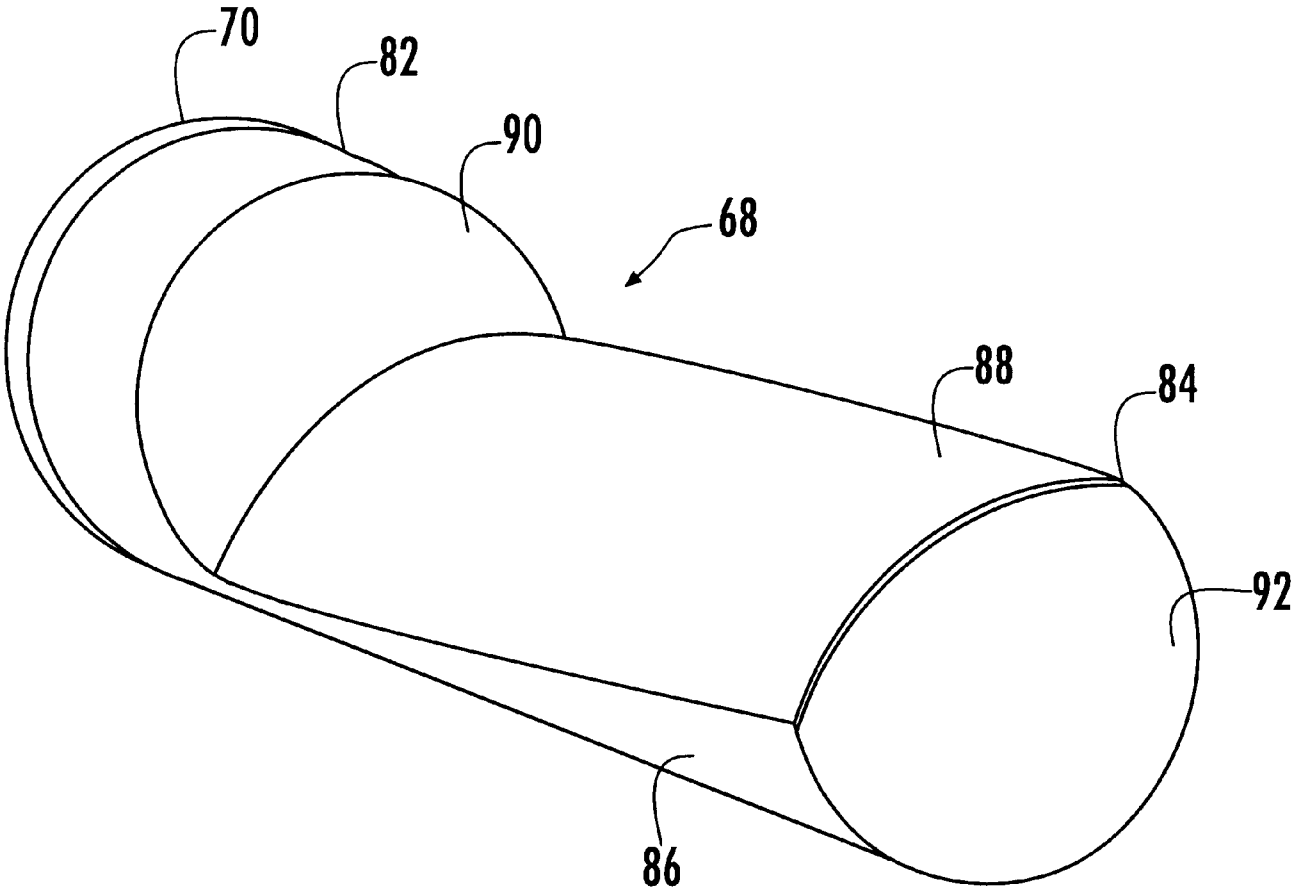
FIG. 4 is an isometric view of a locking piston.
Figure 5:
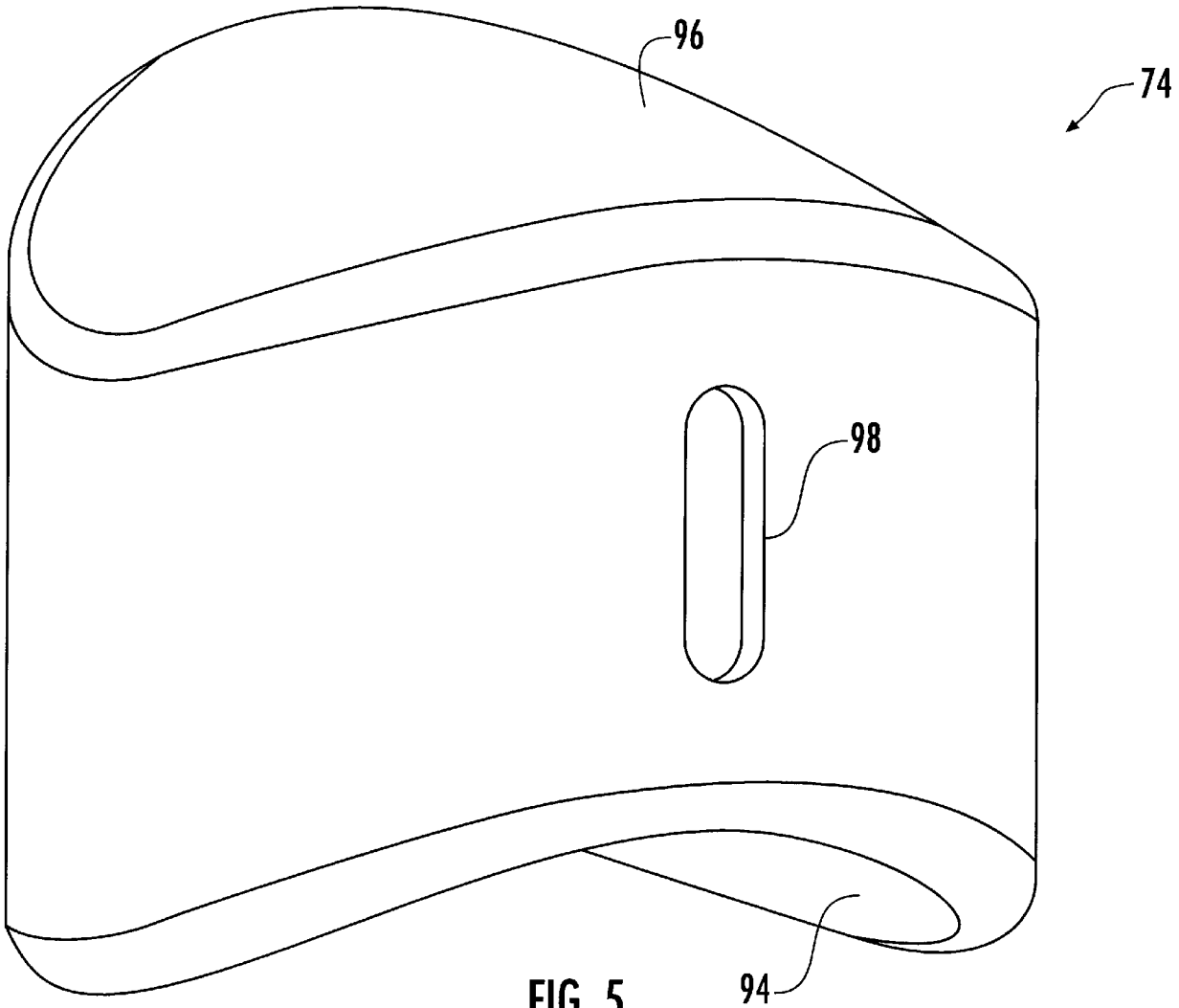
FIG. 5 is an isometric view of a locking segment.

As best seen in FIG. 4, locking piston 68 has circular cross section inner end 82 with locking piston seal 70 positioned thereon. The outer end 84 has a circular cross section face 86 that is equal to circular cross section inner end 82. A portion of outer end 84 is removed to form locking piston locking taper 88 and locking piston segment shoulder 90. Locking piston locking taper 88 is an axially tapered cylindrical surface that tapers axially from locking piston segment shoulder 90 to end face 92 of outer end 84. The curvature of locking piston locking taper 88 in the circumferential direction is equal to that of locking piston inner face 94 of locking piston 74 as best seen in FIG. 5.

Locking segment 74 is of generally circular cross section within inner face 94 curved to mate with and slide along locking piston locking taper 88. Locking segment outer face 96 is similarly curved to engage mating surfaces of bonnet cap 36 in a manner to be described hereinafter. Guide slot 98 is disposed radially in locking segment 74 and cooperates with guide pin 100 in operating piston 58 to guide and orient guide pin 100. Bonnet cap 36 includes a tapered lower inner wall 102 and a straight upper inner wall 104. Machined into walls 102 and 104 are guide channels 106 and 108, respectively. Guide channel 106 is frustoconically curved while guide channel 108 is arcuate shaped to mate with locking segment outer face 96 and allow locking segment 74 to slide along them, thereby maintaining correct alignment.

Figure 3:
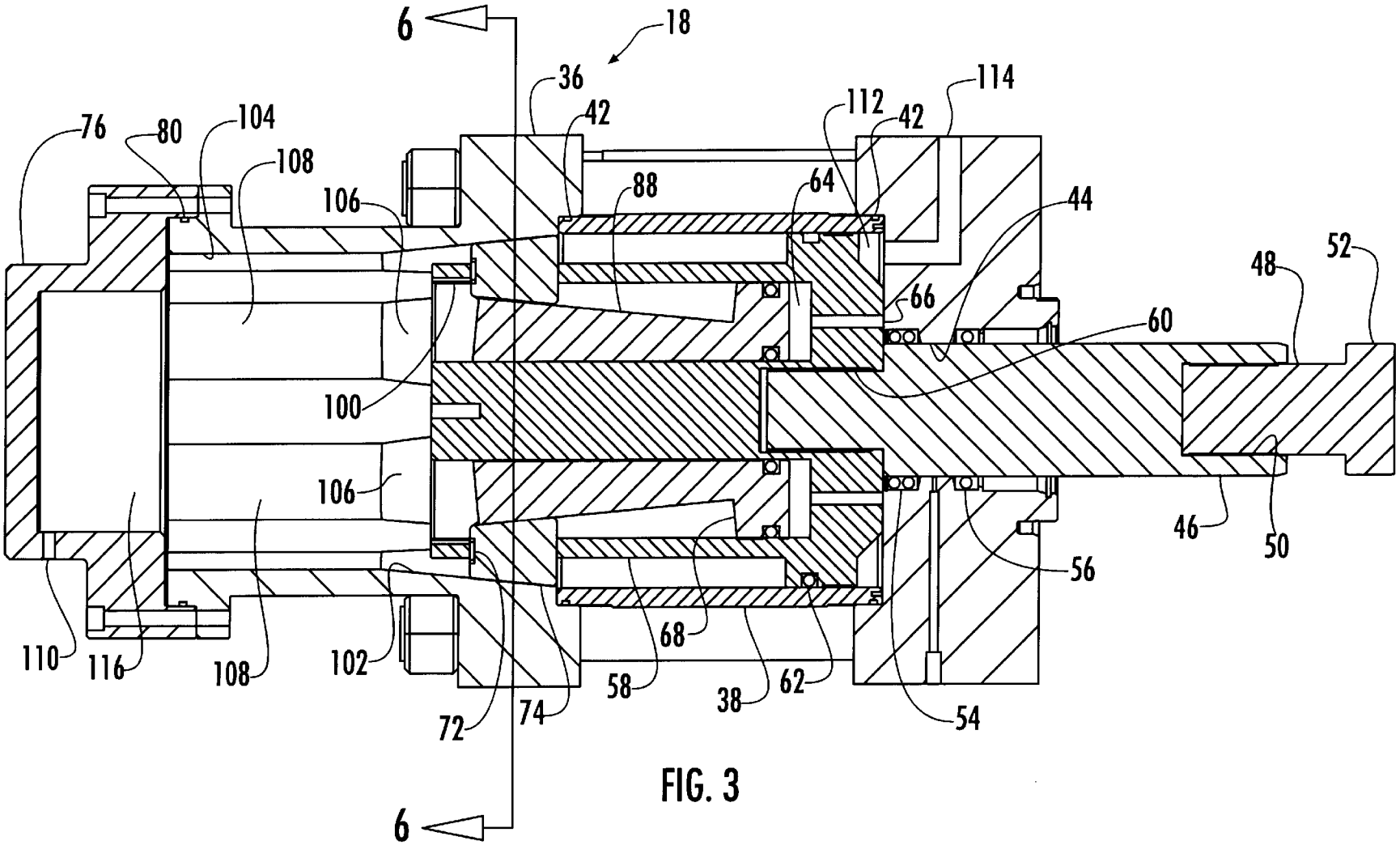
FIG. 3 is a sectional view of the blowout preventer ram automatic locking apparatus locked and the rams closed.

A typical sequence of operations for opening the rams and releasing the blowout preventer ram automatic locking system 32 is as follows. Referring to FIG. 3, operating piston 58 has been moved inwardly, toward the blowout preventer vertical bore 14, in response to fluid pressure introduced into port 110 by a conventional control system well known to those of ordinary skill in the art. In this position, the interaction between the locking piston locking taper 88 of locking piston 68 and the locking segment inner face 94 of locking segment 74 coupled with the interaction between the locking segment outer face 96 of locking segment 74 and the guide channels 106 act as a locking taper to prevent movement of operating piston 58, piston rod 46 and connecting rod 48. These locking tapers will prevent movement of operating piston 58, piston rod 46 and connecting rod 48 even when operating pressure is lost from port 110 and well pressure in the vertical bore 14 of the blowout preventer is acting on ram packer 28 and trying to force operating piston 58, piston rod 46 and connecting rod 48 to their unlocked position. The annular volume between seals 54 and 62 define unlocking piston chamber 112. As pressure is vented from port 110, locking piston chamber 112 is pressurized in response to fluid pressure introduced into port 114. This fluid pressure flows through fluid passages 66 of locking piston 58 into locking piston chambers 64. As pressure builds in locking piston chambers 64, locking pistons 68 are shifted toward the unlocked position of FIG. 2. As locking pistons 68 move outwardly, the pressure acting in unlocking chamber 112 causes operating piston 58 to begin moving outwardly as well. This combination of motion allows locking segments 74 to be cammed radially inwardly by guide channels 106. As locking pistons 68 reach the mid point of their stroke, locking segments 74 are then guided by guide channels 108. In this position, locking segments 74 are in their fully retracted position. This allows operating piston 58 along with piston rod 46 and connecting rod 48 to move to the fully open position of FIG. 2, i.e., with ram packers 28 fully retracted from vertical bore 14.

A typical sequence of operations for closing the rams and activating the blowout preventer ram automatic locking system 32 is as follows. Referring to FIG. 2, operating piston 58 has been moved outwardly as noted above, with the ram packers 28 fully retracted thereby giving the well operator full bore access through the vertical bore 14 of ram type blowout preventer 10. When it is desired to close the ram packers 28, fluid pressure is introduced into port 110 by a conventional control system well known to those of ordinary skill in the art. The annular volume across operating piston seal 62 define locking piston chamber 116. As pressure is vented from port 114, locking piston chamber 116 is pressurized in response to fluid pressure introduced into port 110. This fluid pressure acts across operating piston 58 and locking pistons 68 to cause locking piston 58 to begin shifting from the unlocked position of FIG. 2 to the locked position of FIG. 3. The fluid pressure acting on locking pistons 68 causes the locking piston locking taper 88 of locking piston 68 and the locking segment inner face 94 of locking segment 74 to cam locking segment 74 radially outwardly. This radially outward motion is restrained by the interaction between the locking segment outer face 96 of locking segment 74 and the guide channels 108 until operating piston 58 and locking pistons 68 have moved far enough toward the position of FIG. 3 to allow locking segment outer face 96 of locking segment 74 to engage guide channels 106. This combination of motion allows locking segments 74 to be cammed radially outwardly along guide channels 106 to the fully locked position of FIG. 3. It should be noted that the final locked position of FIG. 3 is determined by the final position of ram packers 28. Thus as ram packers 28 wear and more movement or "stroke" is required, the blowout preventer ram automatic locking system 32 can easily compensate for this wear. This is accomplished by designing the length of the operating piston 58, locking pistons 68 and guide channels 106 and 198 within bonnet cap 36. This provides a blowout preventer ram automatic locking system with infinite locking positions along the full length of the required locking stroke.

Figure 6:
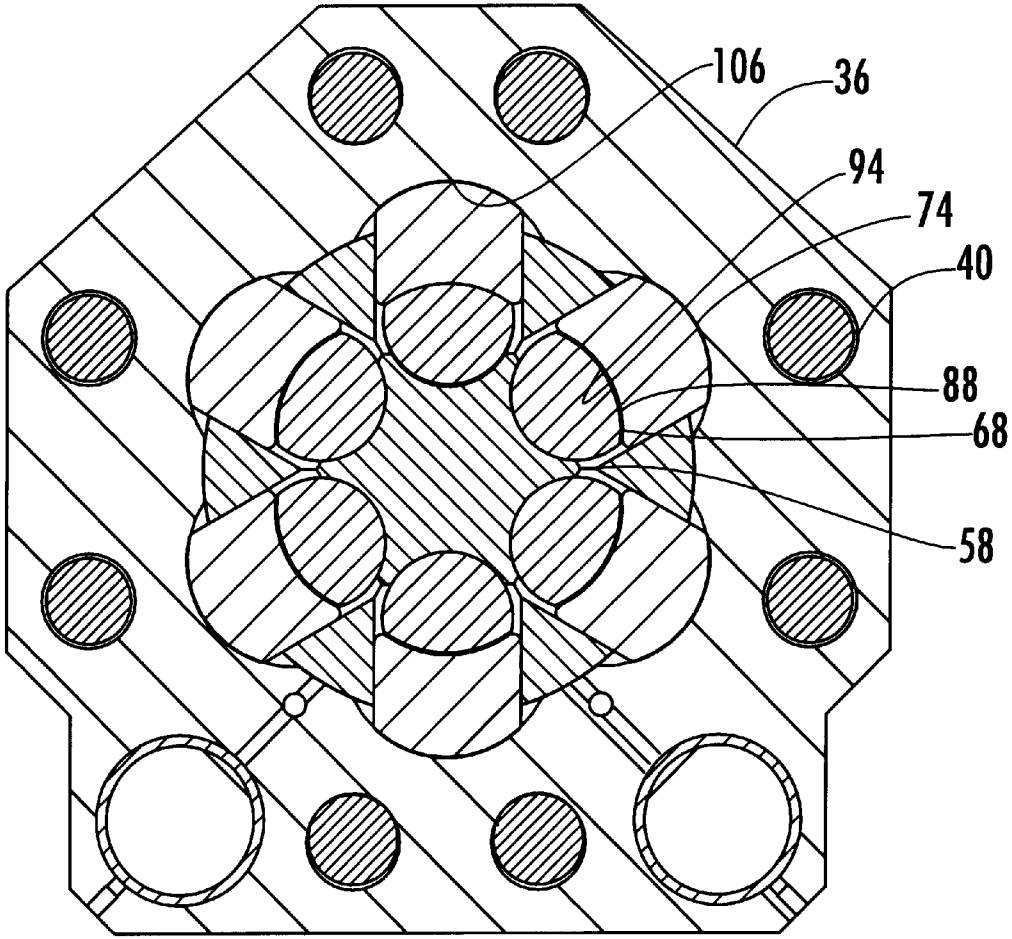
FIG. 6 is a sectional view taken along lines "1—1" of FIG. 3 showing the blowout preventer ram automatic locking apparatus locked and the rams closed.

FIG. 6 is a sectional view taken along lines "1—1" of FIG. 3 showing the blowout preventer ram automatic locking apparatus locked. This view shows the locking segments 74 moved radially outwardly to the locked position. In this position, the locking piston locking taper 88 of locking piston 68 has engaged the locking segment inner face 94 of locking segment 74 to cam locking segment 74 outwardly to allow locking segment outer face 96 of locking segment 74 to contact guide channels 106 of bonnet cap 36 and thereby engage the blowout preventer ram automatic locking system 32.

The construction of my blowout preventer ram automatic locking system will be readily understood from the foregoing description and it will be seen that I have provided a blowout preventer ram automatic locking system that allows locking in an infinite number of positions over a wide range. My system does not require operator intervention to activate the locking system. Furthermore, while the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the appended claims

What is claimed is:

1. A blowout preventer ram actuating and locking apparatus for a blowout preventer used in oil and gas drilling operations, the blowout preventer having a body with an axial bore, a pair of opposing bonnet assemblies and a pair of opposing rams laterally moveable within the bonnet assemblies by a pressurized fluid source to control flow of well fluids through the blowout preventer body axial bore, said blowout preventer ram actuating and locking apparatus, comprising:

a bonnet header sealingly engaging said blowout preventer body;

an operating cylinder sealingly connected to said bonnet header;

a bonnet cap sealingly connected to said operating cylinder and said bonnet header;

an end cap sealingly engaging said bonnet cap;

an operating piston connected to said ram and axially moveable within said operating cylinder by said pressurized fluid source;

a plurality of locking pistons sealingly engaging said operating piston and circumferentially spaced about said operating piston;

a plurality of locking segments cooperating with said locking pistons and said bonnet cap to maintain said operating piston and said ram in a closed position;

a ram unlock fluid passage within said bonnet header for directing said pressurized fluid source to move said operating piston and said ram to an open position; and, a ram lock fluid passage within said end cap for directing said pressurized fluid source to move said operating piston and said ram to a closed position.

2. A blowout preventer ram actuating and locking apparatus for a blowout preventer used in oil and gas drilling operations according to claim 1, wherein:

said operating piston includes a plurality of locking piston chambers circumferentially spaced about said operating piston, said locking pistons disposed within said locking piston chambers and axially moveable within said locking piston chambers by said pressurized fluid source.

3. A blowout preventer ram actuating and locking apparatus for a blowout preventer used in oil and gas drilling operations according to claim 2, wherein:

said locking piston chambers each include a radially disposed slot, said locking piston chamber slots receiving said locking segments in radially sliding engagement, and said locking segments radially moveable in response to fluid pressure applied to said ram lock and said ram unlock fluid passages.

4. A blowout preventer ram actuating and locking apparatus for a blowout preventer used in oil and gas drilling operations according to claim 3, wherein:

said bonnet cap includes a plurality of arcuate shaped guide channels to maintain alignment of said guide segments with said locking pistons.

5. A blowout preventer ram actuating and locking apparatus for a blowout preventer used in oil and gas drilling operations according to claim 4, wherein:

said bonnet cap further includes a plurality of axially tapered cylindrically shaped guide channels, said axially tapered cylindrically shaped guide channels axially aligned with said arcuate shaped guide channels.

6. A blowout preventer ram actuating and locking apparatus for a blowout preventer used in oil and gas drilling operations according to claim 5, wherein:

said bonnet cap axially tapered cylindrically shaped guide channels axial taper is a locking taper.

7. A blowout preventer ram actuating and locking apparatus for a blowout preventer used in oil and gas drilling operations according to claim 6, wherein:

said locking segments inner and outer faces are axially tapered cylindrically shaped with a locking taper axial taper.

8. A blowout preventer ram actuating and locking apparatus for a blowout preventer used in oil and gas drilling operations according to claim 7, wherein:

said locking segments inner and outer faces are axially tapered cylindrically shaped with a locking taper axial taper.

9. A blowout preventer ram actuating and locking apparatus for a blowout preventer used in oil and gas drilling operations according to claim 8, wherein:

said locking pistons include an axially tapered cylindrically shaped surface with a locking taper axial taper, and said locking pistons locking taper axially tapered cylindrically shaped surfaces cooperate with said locking segments inner and outer faces locking taper axially tapered cylindrically shaped surfaces and said bonnet cap guide channels locking taper axially tapered cylindrically shaped surface to maintain said rams in a locked position without pressurized fluid.

10. A blowout preventer ram actuating and automatic locking apparatus for controlling the opening and closing of rams in a blowout preventer, said blowout preventer ram actuating and automatic locking apparatus, comprising:

a bonnet header sealingly engaging said blowout preventer;

an operating cylinder sealingly connected to said bonnet header;

a bonnet cap sealingly connected to said operating cylinder and said bonnet header;

an end cap sealingly engaging said bonnet cap;

an operating piston secured to said ram and axially moveable within said operating cylinder in response to fluid pressure;

said operating piston including a plurality of locking piston chambers circumferentially spaced about said operating piston;

a locking piston disposed within each of said locking piston chambers and axially moveable within said locking piston chambers in response to fluid pressure; and, a plurality of locking segments cooperating with said locking pistons and said bonnet cap to maintain said operating piston and said ram in a closed position.

11. A blowout preventer ram actuating and automatic locking apparatus according to claim 10, wherein:

said bonnet header includes a fluid passage for directing said fluid pressure to move said operating piston and said ram to an open position; and, said end cap includes a fluid passage for directing said fluid pressure to move said operating piston and said ram to a closed position.

12. A blowout preventer ram actuating and automatic locking apparatus according to claim 11, wherein:

said locking piston chambers each include a radially disposed slot, said locking piston chamber slots receiving said locking segments in radially sliding engagement, and said locking segments radially moveable in response to fluid pressure applied to said ram open and said ram close fluid passages.

13. A blowout preventer ram actuating and automatic locking apparatus according to claim 12, wherein:

said bonnet cap includes a plurality of arcuate shaped guide channels to maintain alignment of said guide segments with said locking pistons.

14. A blowout preventer ram actuating and automatic locking apparatus according to claim 13, wherein:

said bonnet cap further includes a plurality of axially tapered cylindrically shaped guide channels, said axially tapered cylindrically shaped guide channels axially aligned with said arcuate shaped guide channels.

15. A blowout preventer ram actuating and automatic locking apparatus according to claim 14, wherein:

said bonnet cap axially tapered cylindrically shaped guide channels axial taper is a locking taper.

16. A blowout preventer ram actuating and automatic locking apparatus according to claim 15, wherein:

said locking segments inner and outer faces are axially tapered cylindrically shaped with a locking taper axial taper.

17. A blowout preventer ram actuating and automatic locking apparatus according to claim 16, wherein:

said locking segments inner and outer faces are axially tapered cylindrically shaped with a locking taper axial taper.

18. A blowout preventer ram actuating and automatic locking apparatus according to claim 17, wherein:

said locking pistons include an axially tapered cylindrically shaped surface with a locking taper axial taper, and said locking pistons locking taper axially tapered cylindrically shaped surface cooperate with said locking segments inner and outer faces locking taper axially tapered cylindrically shaped surfaces and said bonnet cap guide channels locking taper axially tapered cylindrically shaped surface to maintain said rams in a locked position without fluid pressure.

* * * * *